US009157628B2

(12) United States Patent
Gebhard

(10) Patent No.: US 9,157,628 B2
(45) Date of Patent: Oct. 13, 2015

(54) LED LIGHT FOR USE IN A CIGARETTE LIGHTER CASE

(71) Applicant: Albert W. Gebhard, Denver, CO (US)

(72) Inventor: Albert W. Gebhard, Denver, CO (US)

( * ) Notice: Subject to any disclaimer, the term of this patent is extended or adjusted under 35 U.S.C. 154(b) by 154 days.

(21) Appl. No.: 13/717,316

(22) Filed: Dec. 17, 2012

(65) Prior Publication Data

US 2013/0155660 A1 Jun. 20, 2013

Related U.S. Application Data

(60) Provisional application No. 61/576,935, filed on Dec. 16, 2011.

(51) Int. Cl.

| | |
|---|---|
| ***F21L 4/00*** | (2006.01) |
| ***F21V 33/00*** | (2006.01) |
| ***F23Q 7/00*** | (2006.01) |
| ***F21S 10/04*** | (2006.01) |
| *F21S 9/02* | (2006.01) |
| *F21W 121/00* | (2006.01) |
| *F21Y 101/02* | (2006.01) |

(52) U.S. Cl.

CPC ..... *F21V 33/0004* (2013.01); *F21S 10/04* (2013.01); *F23Q 7/00* (2013.01); *F21S 9/02* (2013.01); *F21W 2121/00* (2013.01); *F21Y 2101/02* (2013.01)

(58) Field of Classification Search

CPC ..... F21V 33/0004; F21S 10/04; F21S 9/02; F21W 2121/00; F21Y 2101/02

USPC ..... 362/157

See application file for complete search history.

(56) References Cited

U.S. PATENT DOCUMENTS

| | | | | |
|---|---|---|---|---|
| 5,158,356 | A | 10/1992 | Guthrie | |
| 5,318,177 | A | 6/1994 | Isacson | |
| 5,359,505 | A | 10/1994 | Story | |
| 5,386,351 | A | 1/1995 | Tabor | |
| 5,424,929 | A | 6/1995 | Murray | |
| 5,463,539 | A | 10/1995 | Vandenbelt et al. | |
| 5,515,248 | A | 5/1996 | Canfield et al. | |
| 5,730,013 | A | 3/1998 | Huang | |
| 6,168,288 | B1 | 1/2001 | St. Claire | |
| 6,523,973 | B2 | 2/2003 | Galli | |
| 7,704,071 | B2 * | 4/2010 | Liu et al. | 431/253 |
| 2011/0091827 | A1 * | 4/2011 | Luo | 431/153 |

OTHER PUBLICATIONS

U.S. Appl. No. 29/447,044, filed Feb. 28, 2013; First Named Inventor: Albert W. Gebhard.

Zippo ZipLight Scan of website [http://zippocollect.de/en/zippo/accessories/ziplight.html] showing prior art flashlight distributed by Zippo. Flashlight shown is admitted prior art to the present application.

* cited by examiner

*Primary Examiner* — Anh Mai
*Assistant Examiner* — Jessica M Apenteng
(74) *Attorney, Agent, or Firm* — Margaret Polson; Polson Intellectual Property Law, PC

(57) ABSTRACT

A flash light for use with an external case is disclosed. The flashlight is designed such that when the lid to the case is open, the light automatically is turned on and when the lid is closed the light automatically is turned off.

4 Claims, 3 Drawing Sheets

LED LIGHT FOR USE IN A CIGARETTE LIGHTER CASE

CROSS REFERENCE APPLICATIONS

This application is a non-provisional application claiming the benefits of provisional application No. 61/576,935 filed Dec. 16, 2011, which is hereby incorporated by reference for all purposes.

BACKGROUND

Cigarette lighters with external cases are well known in the art. In the past, people have often used lighters for additional illumination when needed. However, with the decline in smoking and the number of places that people are not allowed to carry lighters that actually produce an open flame, there is a desire for a small light source that can replace the lighter. Further, many people have lighters that are designed with an external, often metal, case and are often refillable with lighter fluid, or have disposable cartridges that are slid into the external case. So there is a desire for a small light source that can be inserted into the external case so that people can continue to use the external case. Also, many people have a fondness for some specific types and/or brands of lighters and what a device that looks like that type of lighter. One such type of lighter is a Zippo® brand lighter, with its iconic case The foregoing example of the related art and limitations related therewith are intended to be illustrative and not exclusive. Other limitations of the related art will become apparent to those of skill in the art upon a reading of the specification and a study of the drawings.

SUMMARY

One aspect of the disclosure is to provide a LED light that will fit in pre-existing cigarette lighter cases.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

In an exemplarily embodiment, a light unit has a case that fits inside of an existing lighter case. Inside the light unit case a LED is connected to at least one battery. A switch is provided that automatically turns on the LED when the lid of the light case is opened, mimicking the action of some lighters that lit automatically when opened.

In addition to the exemplary aspects and embodiments described above, further aspects and embodiments will become apparent by reference to the accompanying drawings forming a part of this specification wherein like reference characters designate corresponding parts in the several views.

BRIEF DESCRIPTION OF THE DRAWINGS

FIG. 4 is a perspective view of the light unit inside a lighter case with the lid of the lighter case open and the light on.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
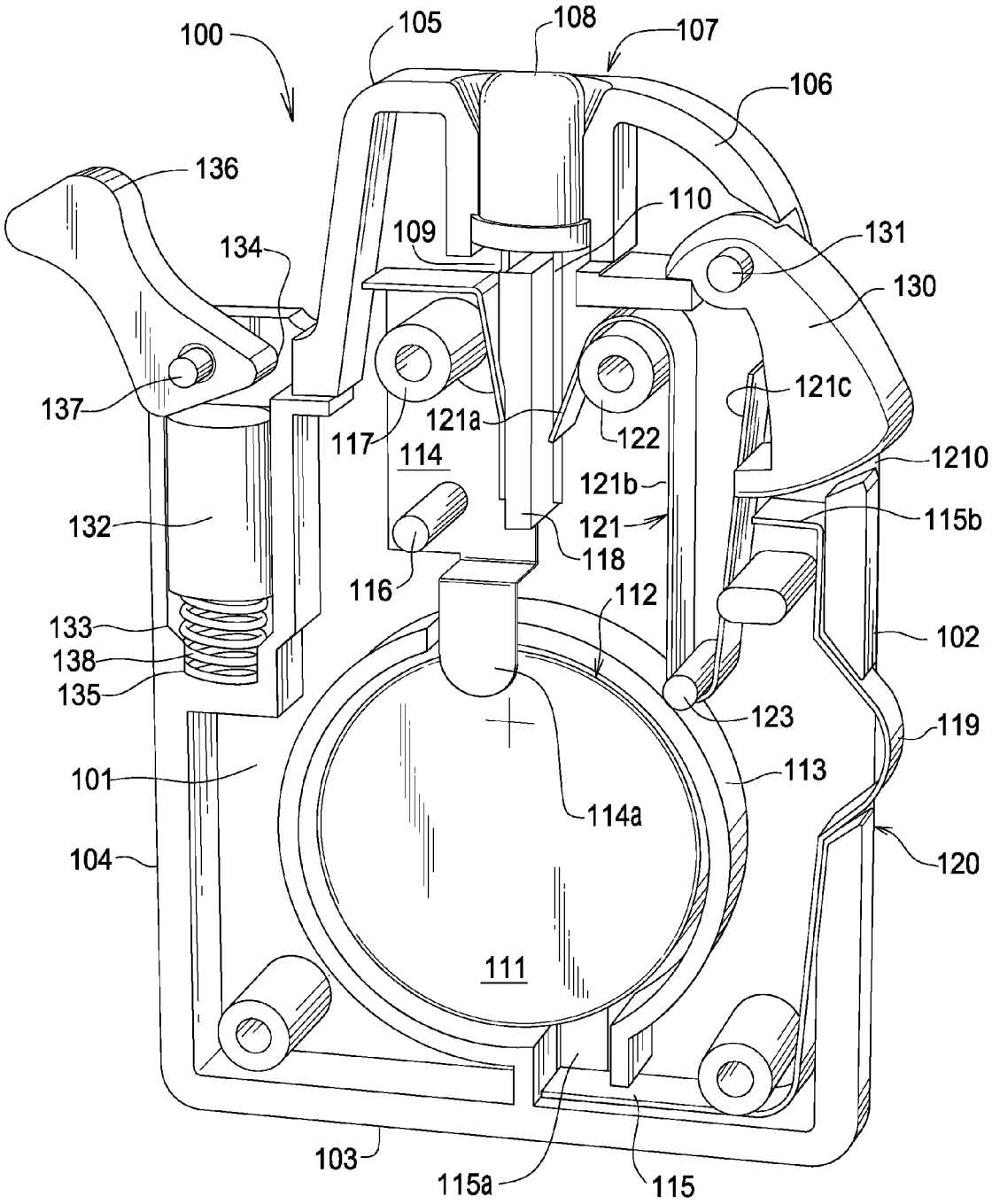
FIG. 1 is a perspective view of the light unit with one half of the case removed before it is put in a lighter case
Figure 2:
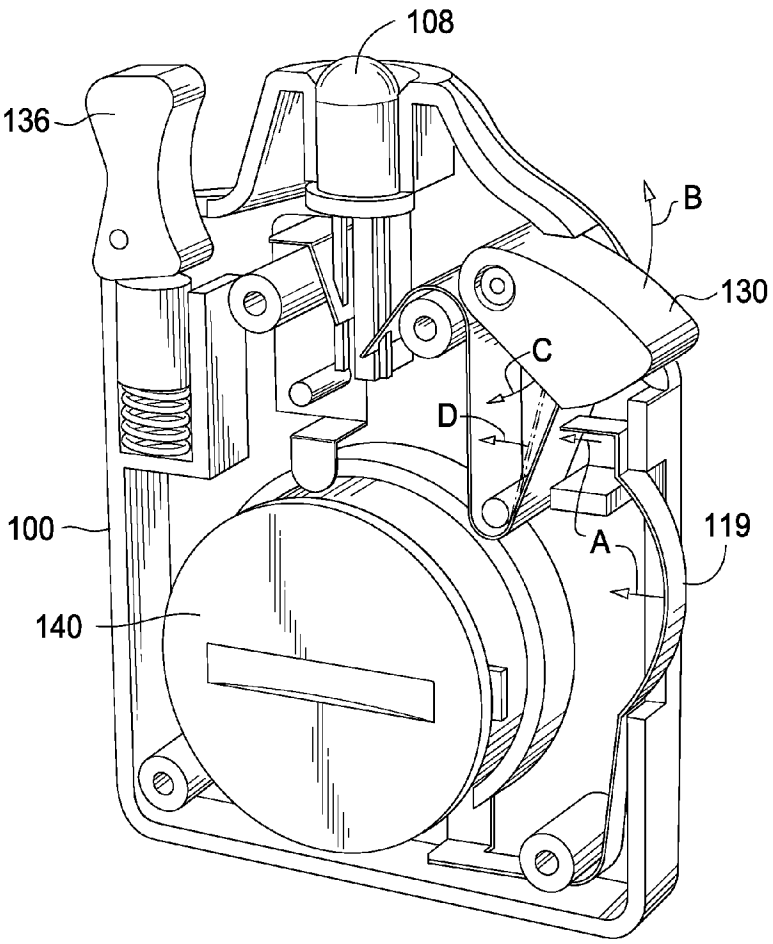
FIG. 2 is a perspective view of the light unit with the battery lid being put into place.

Referring first to FIGS. 1 and 2, light holder 100 has a base 101 with side walls 102, 103 and 104 and upper walls 105, 106. Upper walls 105 and 106 surround aperture 107 which holds LED 108. LED 108 has electrical leads 109, 110 which function to carry current to LED 108 in a known manner. Electrical leans 109, 110 are separated by wall 118 to prevent shorts.

Battery 111 is held in recess 112 formed by walls 113 extending from base 101. In the depicted embodiment, tab 114*a* of upper contact plate 114 and tab 115*a* of lower contact plate 115 press against to the positive and negative terminal of the battery 111 respectively. The choice of which contact plate presses against which terminal of the battery can be reversed. Upper contact plate 114 extends from the battery 111 to the electrical lead 109, providing an electrical connection from the battery to the electrical lead 109. In the depicted embodiment upper contact plate 114 is held in place by pins 116, 117, which extend through holes in plate 114 as shown. Pin 116 is placed to ensure that contact plate 114 is pressed firmly against electrical lead 109 which is in turn pressed against wall 118. Other means of hold plate 114 in place or forming the contact between the electrical lead 109 and the battery 111 could be used as well, no limitation is intended or should be inferred.

Lower contact plate 115 extends along side wall 103 to wall 102, is bent to run along wall 102 and terminated in tab 115*b*. Lower contact plate 115 is bent to form protrusion 119 which extends out of aperture 120 in wall 102. Both contact plates are made of spring steel or any other suitable material. The material needs to be electrically conductive and be resilient enough to function as described herein.

The remainder of the circuit is formed by switch element 121. Tab 121*a* is pressed against electrical lead 110 of LED light 108. Tab 121*a* wraps around pin 122. The main body 121*b* of switch element 121 extends from pin 122 to pin 123. Switch element 121 wraps around pin 123, forming contact plate 121*c*. Contact plate 121*c* extends past tab 115*b* and pivoting button 130. Contact plate 121*c* is presses against pivoting button 130, acting as a bias mechanism to bias pivoting button to the outward position shown in FIG. 1. Pivoting button 130 is pivotally mounted on pin 131.

Referring next to FIG. 2, the battery 111 is held in place by batter lid 140. The battery lid 111 act to compress the battery 111 firmly against battery contacts 114*a* and 115*a* to ensure good connection.

Figure 3:
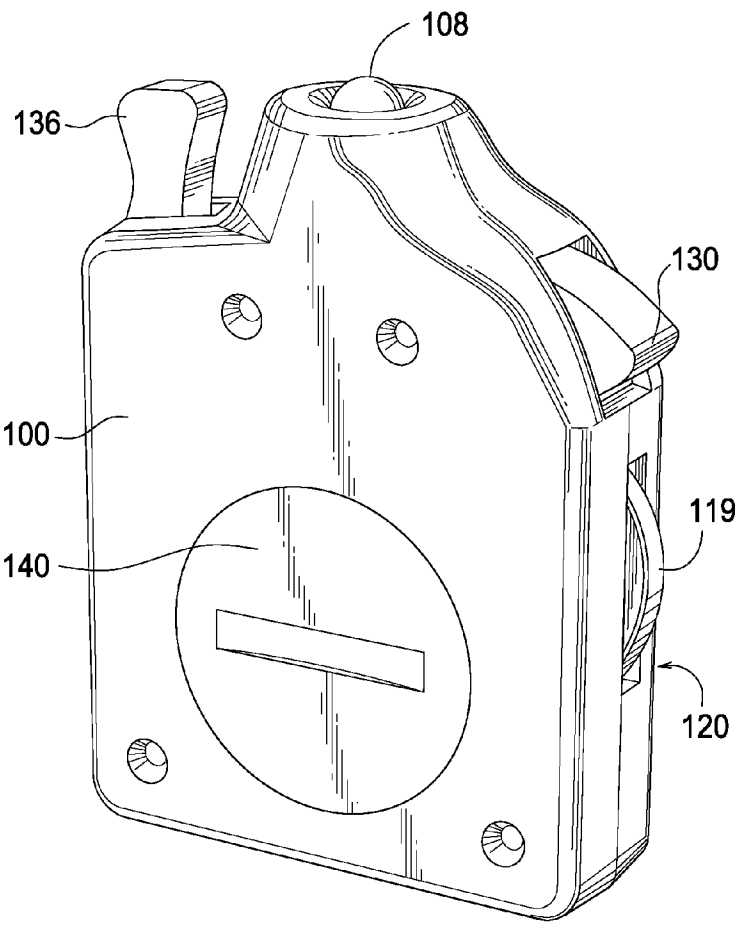
FIG. 3 is a perspective view of the light unit with the case complete.

FIG. 3 shows the light holder 100 with the case closed by top plate mounting on to walls to close light holder 100. The case switch 130 is in the extended position, as is the protrusion 119.

Figure 5:
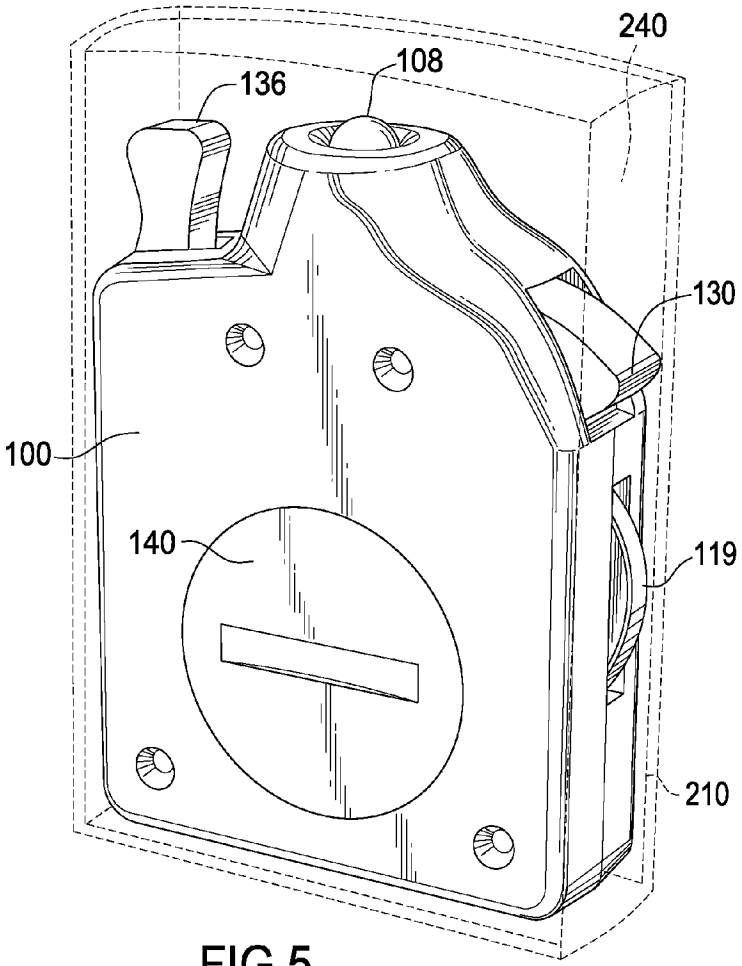
FIG. 5 is a perspective view of the light unit inside a lighter case with the case shown transparent for viewing.
Figure 4:
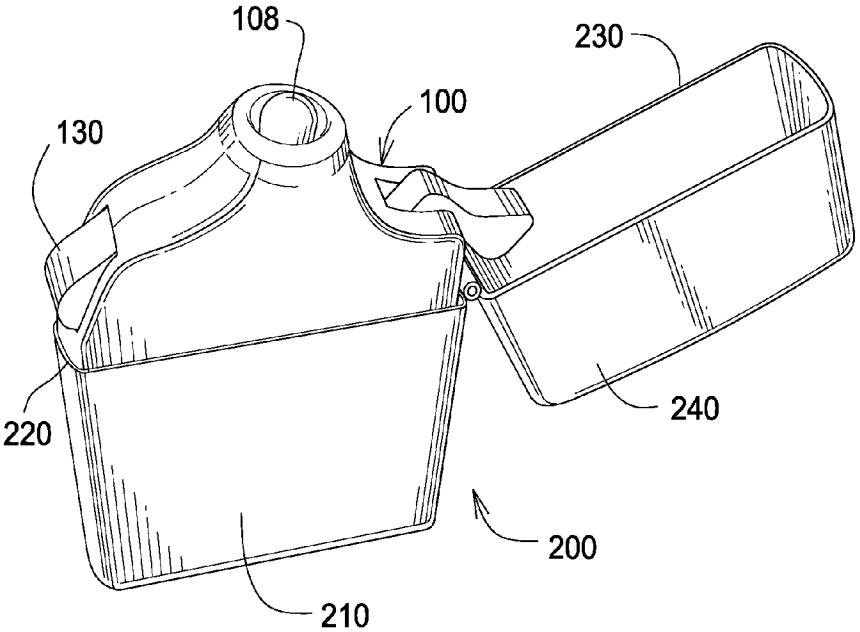

Referring next to FIGS. 4 and 5, in use, light holder 100 is slid into case 200 having a hollow main body 210 and a pivotally mounted hollow lid 240. If case 200 is made of metal, a liner 220 is provided for main body 210 and a liner 230 is provided for lid 240. The liners are made of plastic or other non-conductive material. When light holder 100 is slid in to hollow main body 210, protrusion 119 is pressed inward, moving the lower contact plate inward, moving tab 115*b* towards contact plate 121*c* in the direction shown by arrows A. Pivoting button 130 holds contact plate 121*c* positioned such that when protrusion 119 is pressed inward AND pivoting button 130 is rotated outward in the direction of arrow B, contact plate 121*c* contacts tab 115*b*, completing the circuit and causing the LED to glow. If pivoting button is pressed inward in the direction of arrow C, as happens when lid 240 is closed, then contact plate 121*c* is moved away from tab 115*b*, as shown by arrow D, such that there is not a complete circuit. This means that the bulb 108 is on only when protrusion 119 is pressed in and pivoting button 130 is rotated outward. This occurs naturally when light holder 100 is in hollow main body 210 and the lid in open, as shown in FIG. 4.

When the lid 240 is closed, pivoting button is 130 is rotated inward in the direction of arrow, moving contact plate 121*c* away from 115*b*. As discussed above, this opens the circuit turning off the LED 108 even if protrusion 119 is pressed inward by insertion of the light holder 100 in to a case 200 as shown in FIGS. 4 and 5.

On opposite side of base 101 a cam plunger 132 and spring 133 are secured within an opening 134 defined by wall 101 and inner wall 135. In combination with the lever 136, which is pivotly mounted on pin 137, function to retain the lid 240 in the closed position. The cam spring plunger 132 is hollow with a counterbore (not shown) for the upper end portion of the spring 133. The diameter of the bottom portion of the opening 134 is decreased to provide a bore 138 for accommodating the lower portion of the spring 133, the diameter of the bore 138 being substantially equal to the diameter of the counterbore in the plunger 132. The lever 136, plunger 132 and spring 133 combination are well known to those of ordinary skill in the art and will therefore not be discussed in greater detail.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure.

I claim:

1. A LED light for use in a cigarette lighter case having a hollow interior and a pivotally attached lid, the LED light comprising:

a hollow body having a battery recess and a battery contained therein;

an LED and a first and second electrical lead extending therefrom; the LED extending out of one wall of the hollow body;

said first electrical lead being electrically connected to a first terminal of the battery by a first electrical connector;

a second terminal of the battery being connected to a second electrical connector, said second electrical connector having a portion that extends outside of the hollow body forming a first switch;

a third electrical connector electrically connected to the second electrical lead and extending toward the second electrical connector;

said third electrical connector being pressed against a second switch such that the second is biased in a first direction;

the third electrical connector coming into electrical contact with the second electrical contact when the second switch is moved in a second direction and the first switch is moved in an third direction, completing the circuit and causing the LED bulb to light; and wherein the first switch is automatically moved in the third direction when the hollow body is placed inside of the cigarette lighter case and the second switch is moved in second direction when the lid of the cigarette lighter case is opened completing the circuit.

2. The LED light of claim 1 wherein the second switch is a pivoting switch.

3. The LED light of claim 1 further comprising a mechanism to bias the cover of the light case to a closed position.

4. The LED light of claim 1 wherein the circuit of the light cannot be closed when the first switch not depressed.

* * * * *